United States Patent [19]

Anderson et al.

[11] Patent Number: 4,665,830

[45] Date of Patent: May 19, 1987

[54] GUIDE CONSTRUCTION AND METHOD OF INSTALLATION

[75] Inventors: J. Edward Anderson, Minneapolis; Donald C. Sassor, Stillwater, both of Minn.

[73] Assignee: Regents of the University of Minnesota, Minneapolis, Minn.

[21] Appl. No.: 742,195

[22] Filed: Jun. 7, 1985

Related U.S. Application Data

[63] Continuation-in-part of Ser. No. 463,951, Feb. 4, 1983, abandoned.

[51] Int. Cl.[4] ..... B61B 5/00; E01B 11/00

[52] U.S. Cl. ..... 104/124; 104/125; 238/230; 14/13; 14/14; 14/16.1

[58] Field of Search ..... 104/118, 119, 123, 124, 104/125, 88, 120; 14/3, 4, 13, 14, 16.1, 16.5; 238/230

[56] References Cited

U.S. PATENT DOCUMENTS

| | | | |
|---|---|---|---|
| 429,470 | 6/1890 | McGiehan | 104/124 |
| 448,571 | 3/1891 | Jacobs | 104/124 |
| 2,472,446 | 6/1949 | Standfast | 238/230 |
| 3,147,714 | 9/1964 | Appelt et al. | 104/120 |
| 3,209,702 | 10/1965 | Lemcke | 104/120 |
| 3,377,960 | 4/1968 | Hawes | 104/118 |
| 3,906,863 | 9/1975 | Baldelli | 104/88 |
| 3,971,459 | 7/1976 | Becker et al. | 104/119 |
| 4,187,573 | 2/1980 | Fyfe et al. | 14/16.1 |
| 4,339,214 | 7/1982 | Puccio et al. | 14/16.5 |

FOREIGN PATENT DOCUMENTS

| | | | |
|---|---|---|---|
| 1557598 | 1/1969 | France | 14/16.5 |
| 768868 | 11/1980 | U.S.S.R. | 104/118 |

OTHER PUBLICATIONS

Callender-Hamilton Bridges, booklet pp. 30 and 31, Jul. 1946.

Civil Engineering, Nov. 1945, pp. 513-515.

Jack H. Irving, PH.D., Fundamentals of Personal Rapid Transit, 1978, pp. 198-235.

J. Edward Anderson, Personal Rapid Transit II, 1974, pp. 87-91.

International Transit Compendium, 1983, pp. 125-127.

Cabtrack Studies System Concepts & Design, 1970.

*Primary Examiner*—Robert B. Reeves

*Assistant Examiner*—Dennis H. Pedder

*Attorney, Agent, or Firm*—Merchant, Gould, Smith Edell, Welter & Schmidt

[57] ABSTRACT

A vehicle supporting guideway is presented, the guideway is comprised of upper horizontal stringers, lower horizontal stringers vertically oriented diagonal members affixed to the upper and lower horizontal stringers and horizontally oriented diagonal members are affixed between the lower horizontal stringers. These features present a guideway having an upwardly extending U-shape construction which can be supplied with wheel supporting channels, and upper support channels. The entire structure is reinforced by ribs which are generally within the horizontal stringers, and the entire guideway may be enclosed by a cover. Overlapping members join adjacent sections of the horizontal stringers together. A method of installation includes (1) installing a plurality of posts; (2) positioning a guideway section over one of the posts; (3) lowering the guideway section and clamping it to the post; (4) affixing lower extended overlapping members to the guideway section; (5) repeating steps 2-4 above on adjacent posts; (6) resting the subsequent section on the overlapping members; and (7) affixing lower extended overlapping members to said guideway section and resting these overlapping members on the subsequent section.

21 Claims, 28 Drawing Figures

10
16
40
34
24
26
82
84
42
54
22
39
55
60
64
72
35
37
38
62
52
20
20

FIG. 18
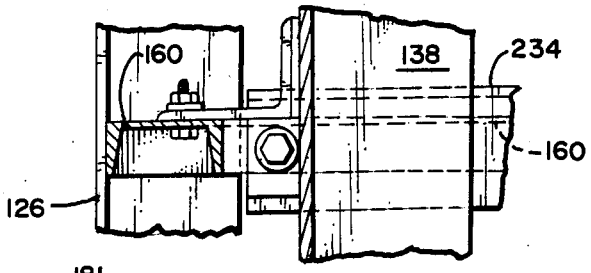
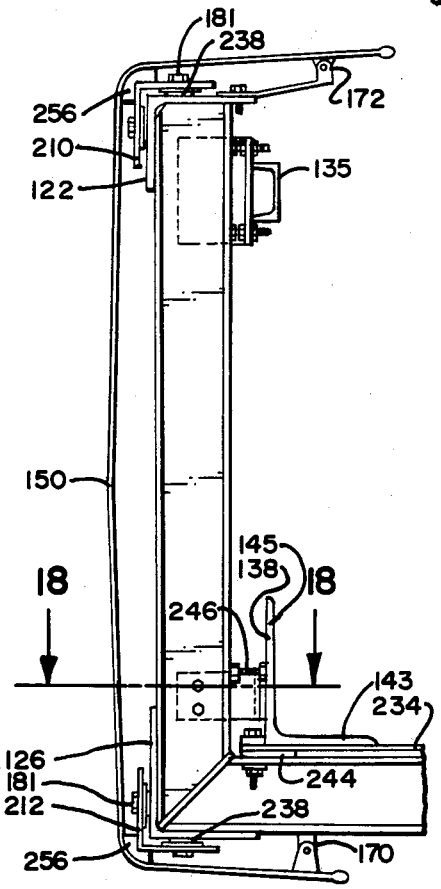
FIG. 19
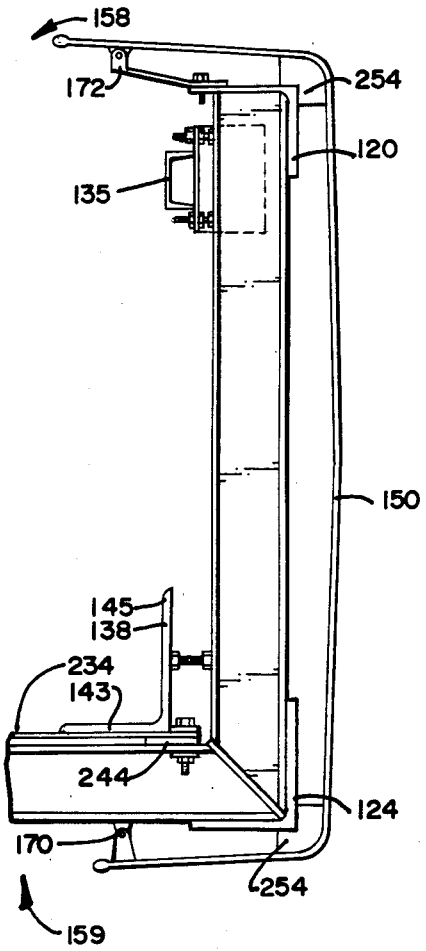
FIG. 20

GUIDE CONSTRUCTION AND METHOD OF INSTALLATION

This is a continuation-in-part of application Ser. No. 463,951, filed Feb. 4, 1983 abandoned and entitled GUIDEWAY CONSTRUCTION and method of installation, now continuation Ser. No. 890,881, filed July 28, 1986.

TECHNICAL FIELD

This invention relates generally to the field of vehicle supporting guideways and particularly to a guideway having a generally U-shaped upwardly opening cross section for supporting personal rapid transit vehicles.

BACKGROUND OF THE INVENTION

This invention is related to the above-described application and to an earlier filed co-pending application Ser. No. 456,860, filed Jan. 10, 1983, now U.S. Pat. No. 4,522,128, entitled Switch Mechanism; and earlier filed copending application Ser. No. 741,567, filed June 5, 1985 entitled SWITCH MECHANISM by J. Edward Anderson and Robert A. Sells, all of which are assigned to the Regents of the University of Minnesota.

With the increase in fuel costs and escalating construction costs for automobile-type surface roads, the need for fuel efficient, economical rapid transit has increased. The state of mass transit at present includes surface buses and surface railway systems as well as underground subway trains and elevated trains and the like. All of these systems attempt to move large numbers of people in large vehicles.

Consequently, the vehicle must stop at a plurality of stations to allow passengers to embark and disembark as desired. Therefore, the effective average speed of the vehicle is reduced by constant stopping and starting, and most riders make numerous stops between the point they get on the vehicle and their intended destination.

A personal rapid transit system would eliminate several of these problems as each vehicle carries a small number of passengers desiring to go to the same destination, and each vehicle bypasses all intermediate stops. Therefore, the average speed of the vehicle can be greatly increased while its maximum speed remains the same, and delays associated with stopping at intermediate points are eliminated. The advantages of this design have been known to those skilled in the art, but the construction of a guideway system which could be constructed economically and which was durable enough to be practical has eluded those in the art.

General background information on transit systems can be found in the Journal of Advanced Transportation, specifically volume 15, No. 2 dated Summer, 1981; *Fundamentals of Personal Rapid Transit* by Jack H. Irving, Ph.D., published in 1978 by D. C. Health and Co., Lexington, Mass.; and *Environment,* specifically Volume 22, No. 8, dated October, 1980, which includes an article entitled "Personal Rapid Transit". Additional information on this subject can be found in the books *Personal Rapid Transit I,* Personal Rapid Transit II and Personal Rapid Transit III published at the University of Minnesota, Minneapolis, Minn., in April 1972, February 1974, and June 1976, respectively.

The elimination of the requirement that a vehicle stop at all intermediate points generally requires that all stopping points be wayside stations or be located on sidings or similarly removed from the main track so that stopped vehicles do not hinder the passage of through vehicles. Therefore, the construction of a track or guideway for this type of system is challenging.

The construction of a guideway system supported above the ground offers several advantages to track systems located either on the ground or below ground. The below ground system offers the obvious disadvantage of requiring tunneling or other expensive right-of-way preparation. Surface tracks also require substantial site grading and right-of-way preparation, and lead to annoying vibration transmitted to nearby structures and people. Grade level tracks are also dangerous to cross traffic and require crossing gates and safety lights. An elevated guideway offers obvious advantages, but the construction of an elevated guideway suitable for use with a personal rapid transit system is challenging.

The problems associated with an above ground installation for a guideway system having wayside stations are numerous, and include the problems associated with harmonic oscillation of the guideway as vehicles pass along its length. The construction of a lightweight guideway strong enough to support a number of individual vehicles passing at moderate or rapid speeds poses a serious oscillation problem. Damping of harmonic oscillation frequencies generally requires an increased guideway mass which further complicates the oscillation problem and increases the cost of the guideway.

It is also desirable to construct the guideway in a prefabricated manner to save on construction and erection costs. Typically, prefabricated guideways suffer from their inability to cope with oscillation. This problem is exacerbated by the typical construction which places guideway supporting posts beneath the ends of each guideway section so that the point of support of each section is the same as its point of attachment to adjacent guideway sections. This construction design causes the center of each guideway section to oscillate with the guideway support posts functioning as node points in the oscillation wave along the length of the guideway.

Oscillation of the guideway creates numerous problems including the requirement for reinforcement structures along the guideway, thereby increasing the guideway's weight and cost. When the weight of the guideway is increased, the oscillation mass is also increased thereby aggrevating the problem. Additionally, oscillation of the guideway greatly detracts from ride comfort within the vehicle, and accelerates wear of the guideway itself caused by flexing. For example, U.S. Pat. No. 3,225,703 issued Dec. 28, 1965 illustrates a device having beams affixed at their ends to support columns. This type of device includes dash pot like devices to manage force transmission between adjacent beams.

As the success of the rapid transit system depends directly on the confidence its ridership has in the functioning and structure of the system, the elimination of oscillation and its associated problems is critical to the construction of an economically feasible and viable guideway and transportation system.

SUMMARY OF THE INVENTION

A transportation system for use with a wheeled vehicle for carrying passengers along a vehicle supporting elevated guideway is disclosed. The guideway includes a plurality of guideway sections linked in end to end relationship. Each section has a pair of upper horizontal stringers located parallel to each other. These upper horizontal stringers generally define the width of the guideway and are placed parallel to and above a pair of lower horizontal stringers. The four stringers run the length of the guideway. A plurality of vertically oriented diagonal members are affixed to the upper and lower horizontal stringers, the diagonal members lying in vertical planes between respective pairs of horizontal stringers and generally span the distance between a number of regularly spaced U-shaped ribs affixed to and substantially enclosed within the stringers. A plurality of horizontally oriented diagonal members are affixed to and join the lower horizontal stringers so that the sides and the bottom are joined by diagonal members forming a generally upwardly extending U-shaped configuration for the guideway.

The guideway thus described further includes a plurality of guideway supporting posts, one placed below each guideway section. The guideway further includes an all-weather cover which aesthetically covers the guideway. The guideway sections are joined in end-to-end relation with overlapping members affixed to the stringers at one end of each guideway section and spaced to slidably receive the end of the adjacent guideway section. The connection points or joints are located substantially at one of the points of zero bending moment within the guideway section between adjacent posts.

BRIEF DESCRIPTION OF THE DRAWINGS

FIG. 18 is a partial sectional plan view taken generally along line 18—18 in FIG. 19, on an enlarged scale;

FIG. 19 is a partial cross-section view taken generally along line 19—19 in FIG. 15;

FIG. 20 is a similar partial cross-section view taken generally along line 20—20 in FIG. 15;

DETAILED DESCRIPTION OF THE INVENTION

Figure 1:
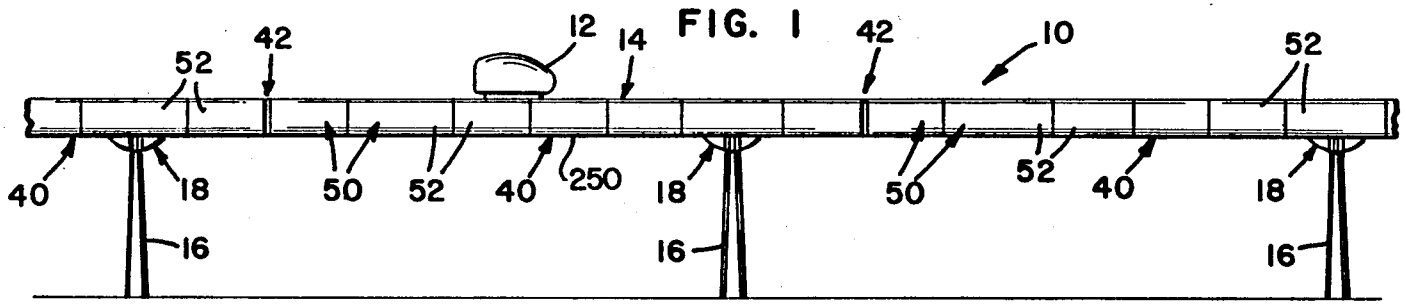
FIG. 1 is a partial side elevational view of the present guideway invention.

In reference now to the drawings wherein like reference numerals correspond to similar components throughout the several views, the guideway 10 is shown in FIG. 1 supporting a vehicle 12, and having a track portion 14 held above the ground by posts 16 with support brackets 18 therebetween.

The vehicle 12 includes a body portion and a bogie portion. The bogie travels substantially within the guideway on wheels, and the vehicle is powered by linear induction motors which are affixed to the vehicle. Details of the vehicle are not shown.

The structure shown in FIG. 1 represents a transportation system for use with a wheeled vehicle 12 supported on the guideway 10. The guideway 10 forms a generally open truss having an upwardly opening U-shaped cross section. (See for example FIG. 7.) The guideway is composed of a number of guideway sections 40 affixed in end to end relation forming a continuous guideway. Each guideway section is supported by a guideway support post 16. Expansion joints 42 are located substantially at the points of zero bending moment within the guideway. The science of statics defines the points of zero bending moment of a uniformly loaded beam with clamped ends as points lying approximately twenty to twenty-five percent of the beam's total length inwardly from each end of the beam. Points of zero bending moment lie at points approximately 25% and 75% plus or minus about 5% along the length of a uniformly loaded beam.

Figure 7:
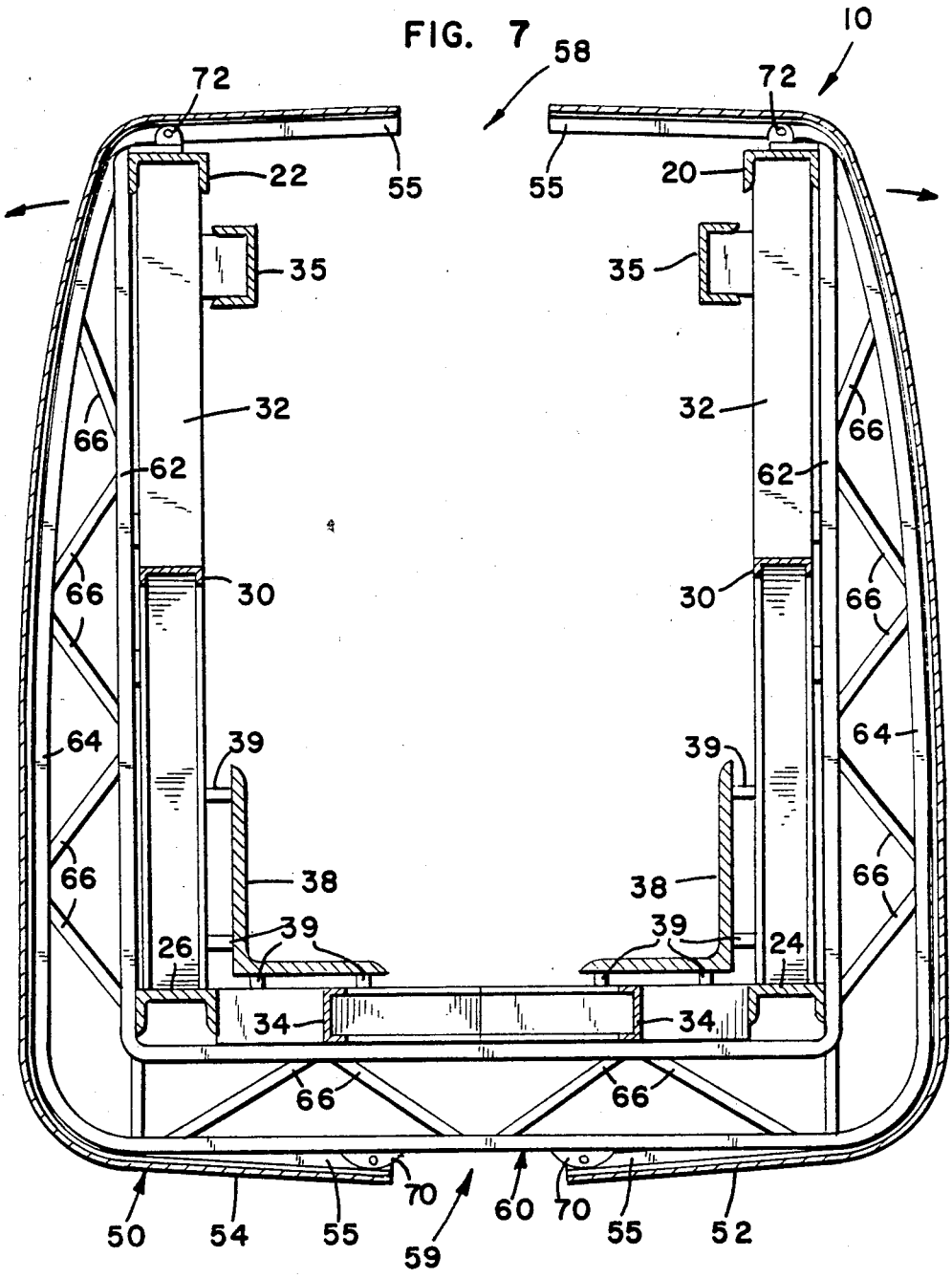
FIG. 7 is a cross sectional view taken along line 7—7 in FIG. 3 shown on an enlarged scale.

As shown in FIG. 7, the guideway consists of a pair of upper horizontal stringers 20 and 22 located parallel to each other and generally defining the width of the guideway 10. A pair of lower horizontal stringers 24 and 26 are located parallel to each other and are placed parallel to and below the upper horizontal stringers 20 and 22 respectively.

Figures 5, 6:
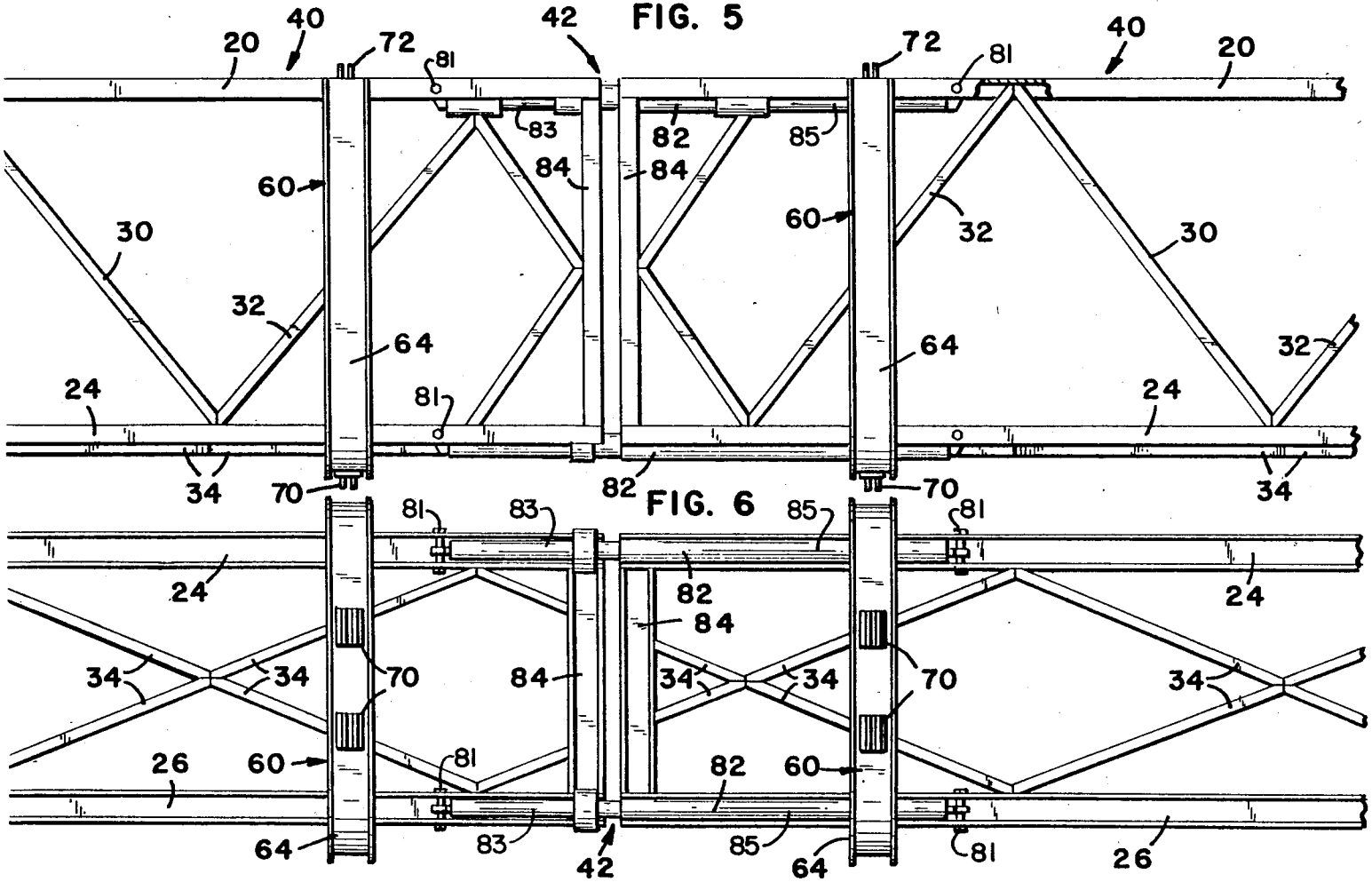
FIG. 5 is a partial diagrammatic side elevational view of an expansion joint within the guideway shown on an enlarged scale.
FIG. 6 is a bottom diagrammatic view of the expansion joint shown in FIG. 5.

A plurality of vertically oriented diagonal members 30 and 32 are affixed to the upper and lower horizontal stringers 20 and 24, or 22 and 26 as shown in FIG. 5 and form a triangular pattern. A plurality of horizontally oriented diagonal members 34 are affixed to join each of the lower horizontal stringers 24 and 26 and form a diamond pattern. In this way, the guideway 10 is defined as a generally upwardly extending, U-shaped structure having upper horizontal stringer 22 and lower horizontal stringer 26 with vertical diagonal members 30 and 32 therebetween defining one vertical leg of the U. Horizontal stringers 26 and 24 with horizontal diagonal members 34 therebetween define the base of the U, with stringers 24 and 20 with vertical diagonal members 30 and 32 therebetween defining the second upright leg of the U.

A pair of main wheel support channels 38 (made of right angle "L" shaped members) are affixed to the guideway above the horizontal diagonal members 34. The support channels 38 lie generally between the vertical diagonal members 30 and 32 and are adjustable both horizontally and vertically within the U-shaped guideway.

The support channels 38 are adjustable with adjusting bolts or shims 39 which lie between the support channels 38 and the guideway 10. These adjusting bolts or shims 39 are placed along the horizontal diagonal members 34 below support channel 38 and on the inside surface of the vertical diagonal members 30 and 32 so as to contact the main support channels 38. These bolts or shims provide a means for adjusting the relative position of the main wheel support channel above and between the horizontal and vertical diagonal members respectively. In this way, a perfectly aligned vehicle carrying support track formed by the support channels 38 can be maintained. Fine adjustments of the support channels 38 within the guideway 10 are possible without the need for expensive, time consuming and difficult alignment of repairs to the guideway itself. The guideway is also provided with upper support channels 35 which stabilize the vehicle as it passes through the guideway.

Figure 2:
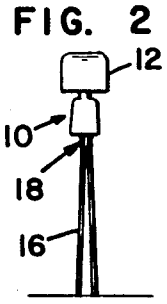
FIG. 2 is an end elevational view of the guideway shown in FIG. 1.
Figure 3:
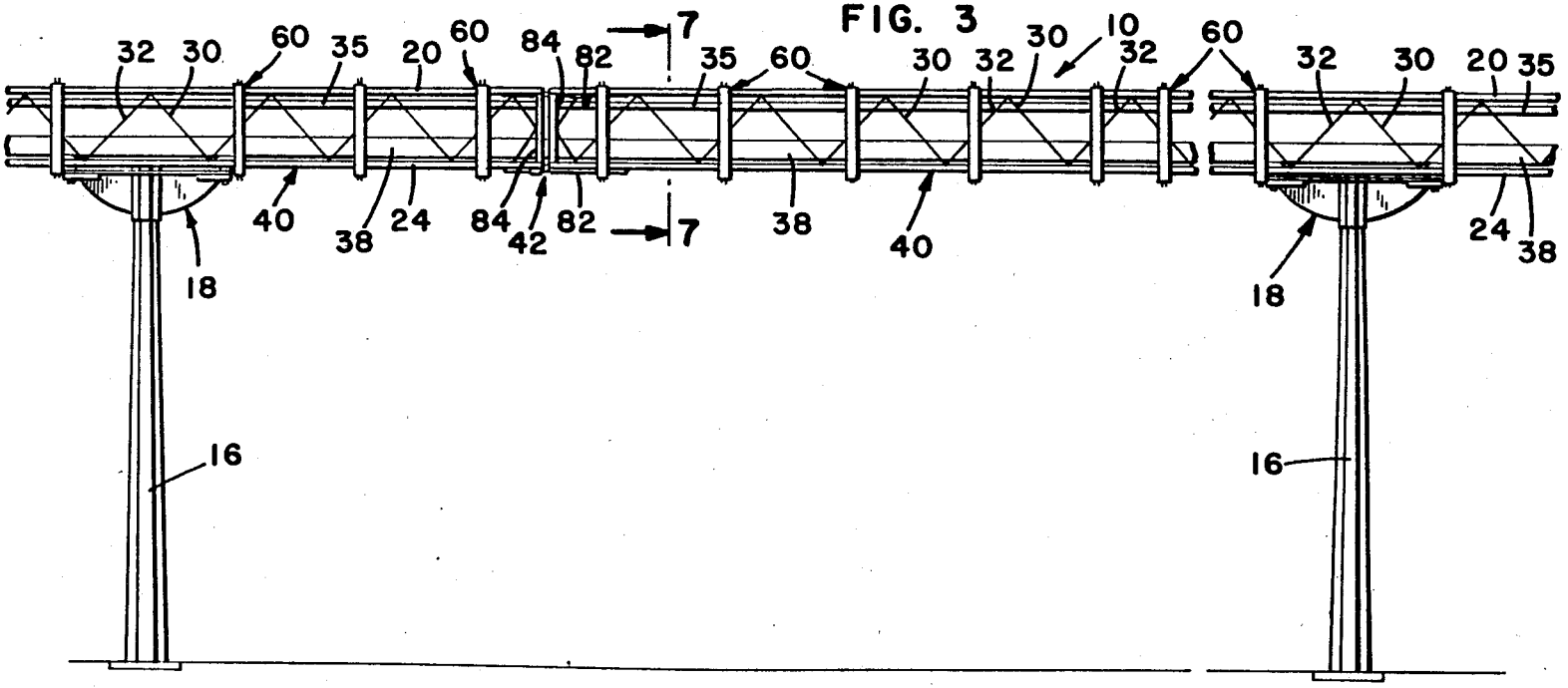
FIG. 3 is a slightly enlarged partial elevational view of the guideway structure having the covers removed.

In reference now to FIGS. 1 and 2, the guideway structure is composed of a plurality of guideway sections 40, each of substantially uniform length. The guideway sections 40 are affixed in end-to-end relation at junction points 42 forming a continuous guideway. The guideway sections 40 are themselves elevated above the ground a desired distance. This elevation is accomplished by a plurality of support posts 16. Each one of the support posts 16 is affixed beneath each guideway section 40. Expansion joints 42 are near the point of zero bending moment of the guideway.

The guideway structure composed of the upper stringers 20 and 22, and the lower stringers 24 and 26, respectively, are additionally stiffened by the application of reinforcing ribs 60 spaced along the length of each guideway section 40. The reinforcing ribs 60 are connected to each of the stringers running the length of the guideway sections and are also attached to the vertical diagonal members 32. The reinforcing ribs 60 provide torsional stiffness to the guideway and thereby increase the natural frequency of oscillation of the guideway to torsional twisting. Therefore the resistance of the guideway to side wind loads and unevenly loaded vehicles is increased.

The reinforcing ribs 60 contact and stiffen the vertical diagonal members 32 which are held in compression within each guideway section 40. The remaining vertical diagonal members 30 are held in tension within the guideway. The weight of the guideway sections themselves, of course, exert forces along the truss structure of the guideway sections 40. These forces hold the vertical diagonal members 30 in tension in that a pulling force is exerted along their length, and the vertical diagonal members 32 are held in compression with a pushing force exerted upon their length. By placing the reinforcing ribs 60 to cross approximately in the middle of the vertical diagonal members 32, the resistance of members 32 to buckling is increased four-fold. The resistance of a member under compression to buckling increases by a factor of four as the length of the member is reduced by a factor of two. Therefore, significant strength is added to the guideway sections 40 without increasing the beam's weight by placing the reinforcing rib 60 to intersect and stiffen the vertical diagonal members under compression.

In reference now to FIG. 7, the reinforcing ribs 60 themselves are composed of an inner channel 62 having a generally U-shape and conforming closely to the dimensions and configuration of the guideway as defined by the upper and lower stringers 20–26, respectively. The reinforcing rib 60 also includes an outer channel 64 having a generally U-shaped configuration. The outer channel is joined at its free ends to the free ends of the inner channel 62. The outer channel 64 is of somewhat longer length than the inner channel and is spaced therefrom along its length except near the free ends of the inner and outer channels 62 and 64 respectively. The inner and outer channels 62 and 64 are located with respect to each other by a stiffening bar or channel 66 which is affixed to the inner and outer channels 62 and 64 in alternating fashion forming a plurality of triangular shaped openings between the channels. This design provides a reinforcing rib 60 which provides significant torsional stiffness to the guideway.

It is expected that a guideway constructed with the design described above (and below with respect to the preferred embodiment) will provide a guideway having the lightest overall weight for its load bearing capacity. Light guideway weight with a large load bearing capacity has the advantange of providing a guideway which has a sufficiently high natural frequency of oscillation to allow suitable vehicle speeds. For example, a guideway constructed of a heavy material may prove to have a natural frequency of oscillation of one cycle per second. Assuming a guideway section length of sixty feet or twenty meters, a vehicle speed of only twenty meters per second could be sufficient to cause serious oscillation problems. These problems are caused by the natural oscillation of the guideway being amplified by the passage of the vehicle over the guideway at a speed corresponding to the natural oscillation frequency, i.e. one guideway section per second. This problem is further increased by a guideway design which places support posts only beneath the joints of adjacent guideway sections.

A guideway having a significantly higher natural oscillation frequency, (for example an open truss design being supported by posts, and having expansion joints between guideway sections near the points of zero bending moment of the guideway) can support a vehicle moving at greater speeds without oscillation problems. Oscillation problems cause wear to the guideway due to flexing and bending, and more importantly decrease ride comfort for the passengers, as the passengers are exposed to vertical accelerations as the guideway oscillates. Additionally, the guideway constructed along the design above described will be economical to produce and maintain.

The guideway itself is substantially enclosed by a cover 50 having a first half 52 and a second half 54. (See FIGS. 1 and 7.) The cover halves are hingedly affixed to the reinforcing ribs 60 along the length of the guideway 10. The cover halves 52 and 54 are hinged at the bottom of the outer bar 64 of the reinforcing ribs 60 at hinge points 70. The hinge points 70 are located slightly offset from the center of the outer bar 64. The cover halves 52 and 54 are pinned, for removeable attachment, or otherwise affixed to the tops of the upper stringers 20 and 22, respectively, at pin points 72. The cooperation of the pin fixture points 72 and the hinges 70 allow the covers to be folded back for easy access to the guideway sections 40 for maintenance procedures and the like. The cover halves 52 and 54 are stiffened by stiffening ribs 55 (See FIG. 8) which provide strength for the attachment of the hinges and pins 70 and 72. Stiffening ribs 55 are of "T" shaped cross-section. The cover 50 is segmented, meaning it is composed of a large number of smaller pieces each spanning a distance of approximately the span between three reinforcing ribs 60. In this way convenient access to the guideway is provided, with the cover halves being of manageable size.

It should be noted, that the cover 50 substantially encloses the guideway but for an upper slit 58 and a lower slit 59. The upper slit provides a continuous opening running the length of the guideway for passage of the support vehicle. The lower slit 59 allows rain, snow, debris and other material which may find its way into the guideway to pass out of the guideway. The cover 50 greatly reduces the amount of such material which finds its way into the guideway. Additionally, the cover improves the aesthetic appearance of the guideway structure. Additionally, the cover protects the guideway from lightning which can damage the electrical wiring within the guideway used to power and control the vehicles 12. The cover 50 also protects the guideway support channels 38 and the power rails from the night time sky which can produce frost on exposed surfaces during cool weather. The cover 50 also provides containment should a fire occur within the guideway, and shields the environment from electromagnetic noise created by the system.

In reference now to FIGS. 5 and 6, the two guideway sections 40 are shown in end-to-end relationship with an expansion joint 42 therebetween. The expansion joint includes four fluid filled cylinders 82 fixed at their ends to the stringers 20–26 of the guideway sections 40. The cylinders 82 serve to dampen the transmission of vibration from one guideway section to the adjacent guideway section. It is expected that the cylinders 82 will be filled with heavy grease or other high viscosity liquid. The cylinders 82 function as "shock absorbers" and will absorb low frequency vibration, transmitting high frequency vibration.

As seen in FIGS. 5 and 6 the fluid filled cylinders 82 are affixed to the stringers 20–26 by bolts 81. Each cylinder 82 has a ram 83 which fits within a sleeve 85. Each ram 83 is affixed to one stringer while the corresponding sleeve 85 is affixed to the stringer across the expansion joint 42. The rams are slidable within the sleeves with their motion damped with fluid or grease as in any conventional shock absorber. Internal damping or valving, or other known mechanisms to restrict or channel the flow of fluids within the clyinders 82 (not shown in the drawings) would be possible.

In practice, the expansion joints 42 allow thermal expansion within the guideway to take place without effecting the ride comfort or smoothness of the guideway.

Figures 4, 8:
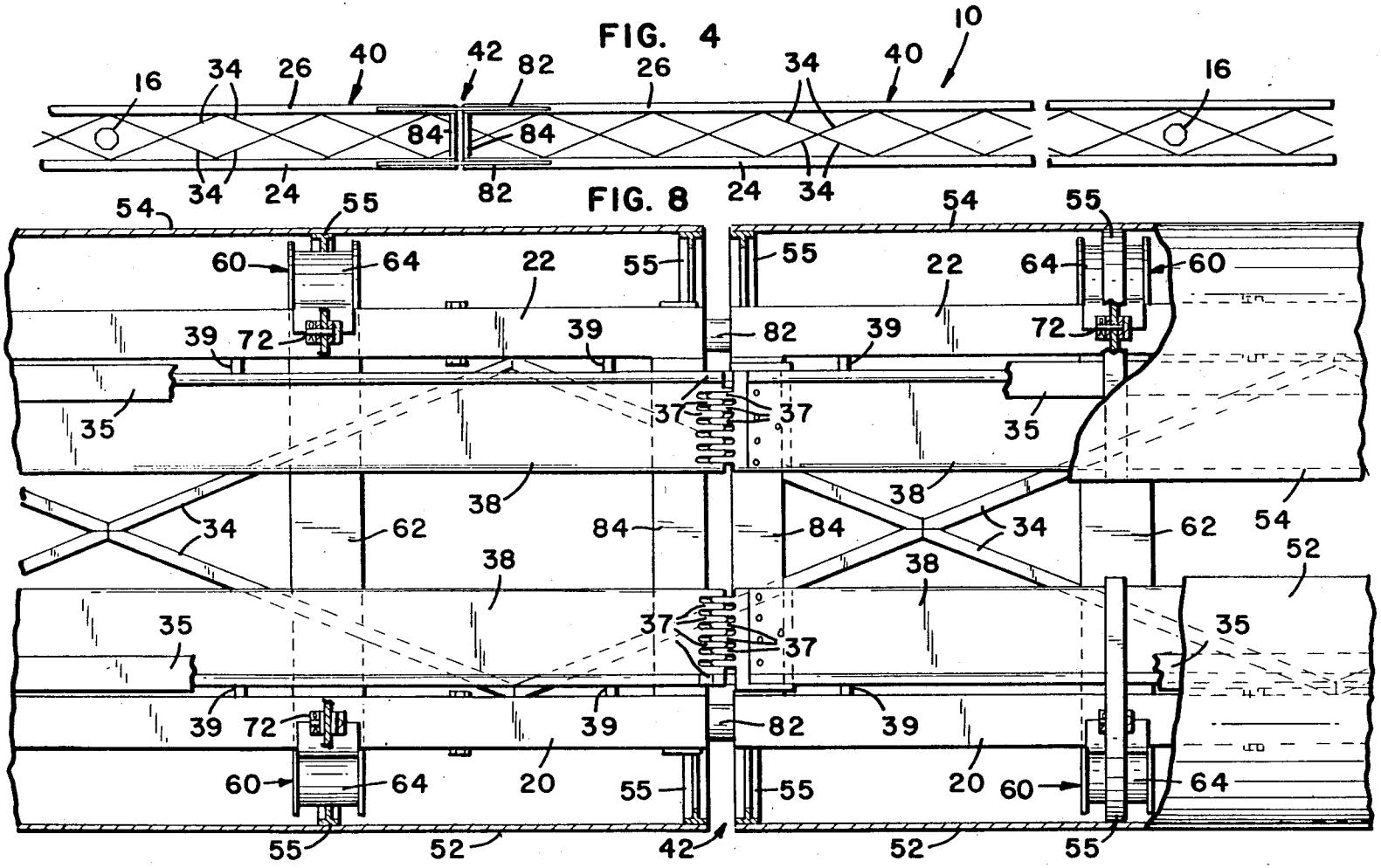
FIG. 4 is a partial diagrammatic bottom view of the guideway shown in FIG. 3.
FIG. 8 is a plan view of a portion of the expansion joint shown in FIG. 6 with the covers partially shown and the support channels installed.

The expansion joints 42 further include end plates 84 which run between the upper and lower stringers 20–26 and stabilize the ends thereof. A further aspect of the expansion joints 80 is shown in FIG. 8. To provide a smooth vehicle path over the expansion joint 42, the support channels 38 are provided with support channel fingers 37 attached to the ends of the support channels 38. The support channel fingers 37 are arranged to interlock so that as the support channel sections 40 expand or contract, a smooth, continuous surface is provided for the vehicle traveling on the guideway. Similar fingers (not shown) are placed on the upper support channels 35. The smooth joint is produced by placing the expansion joint substantially at the point of zero curvature, or zero bending moment within the guideway.

Figure 9:
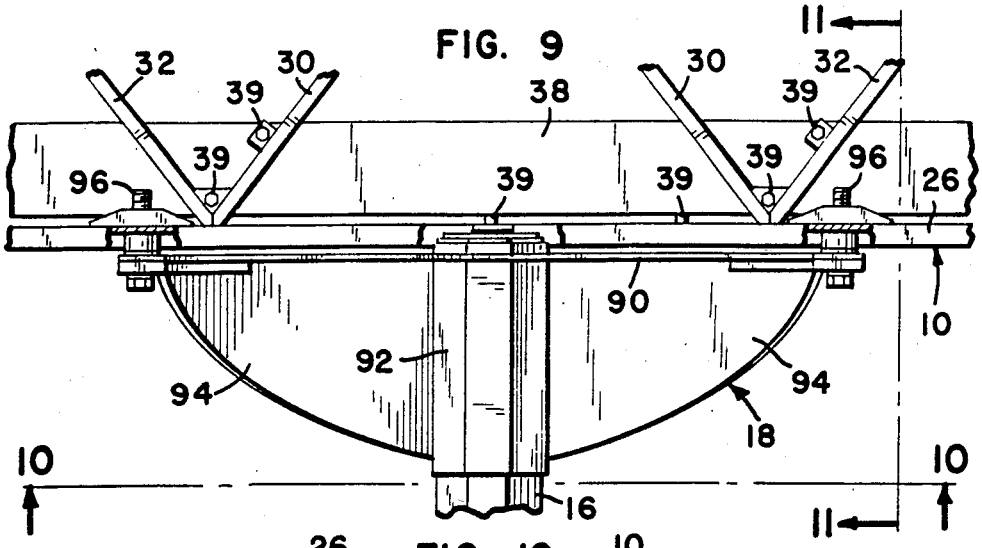
FIG. 9 is a partial elevational view on an enlarged scale showing a support post, a support post bracket and the guideway.
Figure 10:
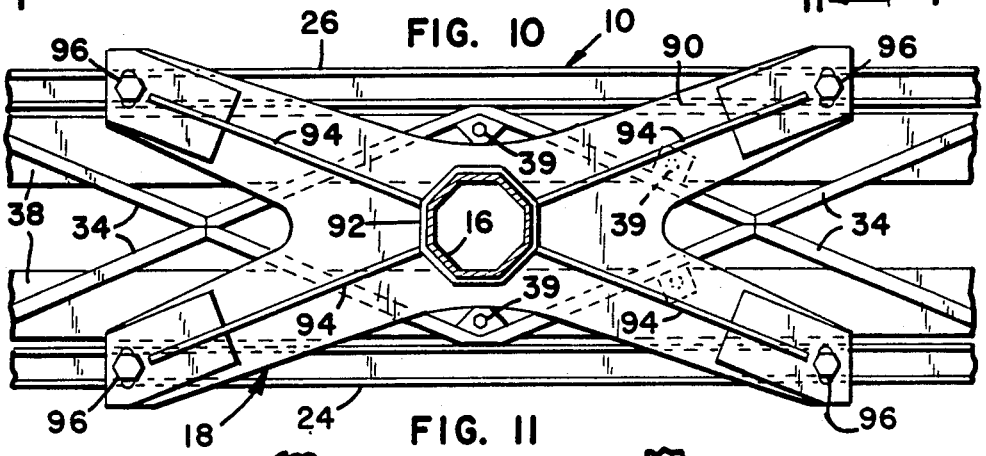
FIG. 10 is a partial sectional view on an enlarged scale taken along line 10—10 in FIG. 9.
Figure 11:
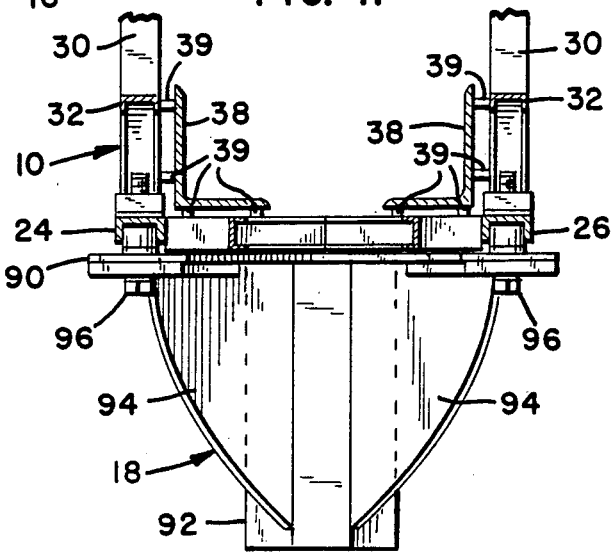
FIG. 11 is a partial sectional view on an enlarged scale taken along line 11—11 in FIG. 9.

In reference now to FIGS. 9, 10 and 11, the design of the support bracket 18 and its installation on the support posts 16 and the guideway 10 is shown. The support bracket 18 includes a generally X-shaped member 90 placed in a plane parallel to the guideway. A sleeve 92 is provided for fitting over the posts 16. A number of stiffening fins 94 are placed between the X-shaped member 90 and the sleeve 92 to stiffen the support bracket 18. The bracket itself is attached to the lower stringers 24 and 26 by bolts 96 or the like (See FIGS. 3 and 9–11.) The bolts 96 allow the guideway section to be affixed or clamped to the support post in four places or points, each clamping place or point spaced from each adjacent point a sufficient distance to transfer torque within the guideway to the post. The distance shown is at least the distance between the lower support channels. (See FIGS. 10 and 11).

It should be noted that the support bracket 18 and the support posts 16 are positioned along the length of the guideway section so that the support post is centered beneath a diamond shaped opening formed by the horizontal diagonal members 34. (See FIG. 10.) This positioning becomes important to an understanding of how the guideway is installed as will be described below.

It is anticipated that the preferred method for installing the guideway will include prefabricating the major components including the support posts 16, the support brackets 18, and the guideway sections 40. These components will then be shipped to the installation site which has been prepared. The support posts 16, being of uniform length, are installed at generally uniform distances along the desired path of the guideway. At this point, the support bracket 18 is installed over the top of the support posts, or the bracket can be installed prior to erecting the posts. Next, one prefabricated guideway section 40 is installed on the support post 16 and support bracket 18. The exact height of the guideway section above the ground is variable by adjusting the support bracket vertically on the post, and/or by placing shims or other spacing members between the support bracket and the guideway itself. The guideway section 40 is installed so that the support post 16 is generally centered through the diamond shaped opening formed by the horizontal diagonal members 34 approximately 21% of the distance from the end of each guideway section 40.

The guideway section 40 can then be affixed to the support bracket 18 which is slid vertically up and down on the support post 16 until the guideway 40 is at the desired height above the ground. The support bracket 18 can then be welded or otherwise affixed to the support post 16 and any excess length of the support posts 16 can be removed with a cutting torch or the like. The guideway sections can then be connected to each other with expansion joints 42 as described above. The guideway sections 40 are linked in end-to-end relationship by the expansion cylinders 82 which stabilize the ends of the guideway sections and permit the guideway to be fully supported along its length. In this way a continuous, smooth, vehicle supporting guideway is provided.

Certain materials are expected to produce satisfactory results when employed in the manufacture of the above described guideway. For example, octagonally tapered steel posts are expected to prove satisfactory for the support post 16 and common rolled steel stock is expected to perform satisfactorily for the stringers 20–26. These should, as shown, be of channel construction and should be positioned within the guideway so as not to accumulate moisture or snow. The outer reinforcing ribs 60 can be composed entirely of thin stock steel or either conventional or exotic alloys having a channel-shaped cross-section. The support channels 38 should be made of a steel right angle stock or other magnetically permeable rigid material, and it is expected that they should have an aluminum clad layer along their surface for improved interaction with the linear induction motors which propel the vehicle. (Linear induction motors are not shown in the drawings.) The covers 50 may be of aluminum or may be made of thin silicon steel alloy or reinforced fiberglass. The cover panels 52 and 54 can have a reinforcing member of steel or other material increasing their rigidity and providing convenient anchoring points for the hinges and pin points 70 and 72, respectively.

THE PREFERRED EMBODIMENT

In reference now specifically to FIGS. 12–26, the preferred embodiment of the present invention is shown. Throughout these views, and the following discussion, parts which generally correspond or have somewhat related functions to the parts discussed above will have similar parts numbers preceded by the digit 1. For example, a part discussed above with reference numeral 15 will appear in the following discussion on a similar or related part with numeral 115.

As can be seen in FIGS. 12–15, the continuous wheeled vehicle supporting guideway has a plurality of guideway sections 140 each being of substantially uniform length and affixed in end-to-end relation. Each of the guideway sections 140 has an elongated pair of upper horizontal stringers 120 and 122 located parallel to each other. A pair of elongated lower horizontal stringers 124 and 126 is located parallel to each other and placed parallel to and below the upper horizontal stringers 120 and 122. (See also FIGS. 19 and 20).

A plurality of upwardly opening U-shaped reinforcing ribs 160 are spaced from each other and affixed to and substantially enclosed within the stringers 120-126. The reinforcing ribs 160 are in regular spaced relation and lie generally in vertical planes, along the entire length of each guideway section 140. A plurality of diagonal members 130 are affixed in tension to the upper and lower horizontal stringers in vertical planes. The diagonal members 130 generally span the diagonal distance between the spaced apart U-shaped ribs 160.

A plurality of horizontally oriented diagonal members 134 are affixed to and join the lower horizontal stringers 124 and 126. The horizontally oriented diagonal members 134 generally span the diagonal distance between the U-shaped ribs 160. A pair of parallel main wheel support channels 138 are affixed above the U-shaped ribs 160.

The entire guideway is elevated a desired distance above the ground on a plurality of support posts 116, each having a support post cap 118. One of the support posts 116 is affixed beneath each of the guideway sections 140 at a location approximately 25% of the length of the section from one end thereof. The support post caps 118 engage and generally support two U-shaped ribs 160, and span the distance therebetween. This connection should be rigid so that the stiffness of the support post 116 is transmitted to the guideway. The support post caps 118 may be attached to the lower horizontal stringers 124 and 126 at a number of points (see FIGS. 12 and 13.) this attachment clamps the guideway section to the support post 116.

Joints between adjacent, guideway sections 140 include extended overlapping L-shaped members 210 and 212. The overlapping members are affixed at one end thereof to one end of each of the guideway sections 140. The overlapping members extend beyond the ends of the guideway sections 140 and slidably receive the adjacent end of an adjacent guideway section. The overlapping members are rigidly affixed with bolts 181 or other suitable devices to only one of the guideway sections. The adjacent guideway section is free to move longitudinally, within a limited range, in slidable bayonet fashion. This feature accommodates thermal expansion of each guideway section and otherwise transmits forces longitudinally along the guideway to be absorbed. Shear forces, or forces tangent to the longitudinal axis of the guideway are transmitted from one guideway section to the adjacent section by the overlapping members.

Spacer pads 238 are positioned between the overlapping members 210, 212 and the horizontal stringers 120–126 on the end of the guideway section 140 to which the overlapping members 210 and 212 are affixed. Wear pads 236 rest between the overlapping members and the horizontal stringers on the adjacent end of the next guideway section. In this way, the guideway sections 140 are affixed in end-to-end relation while thermal expansion is accommodated without the adjacent guideway sections contacting each other directly.

Figure 12:
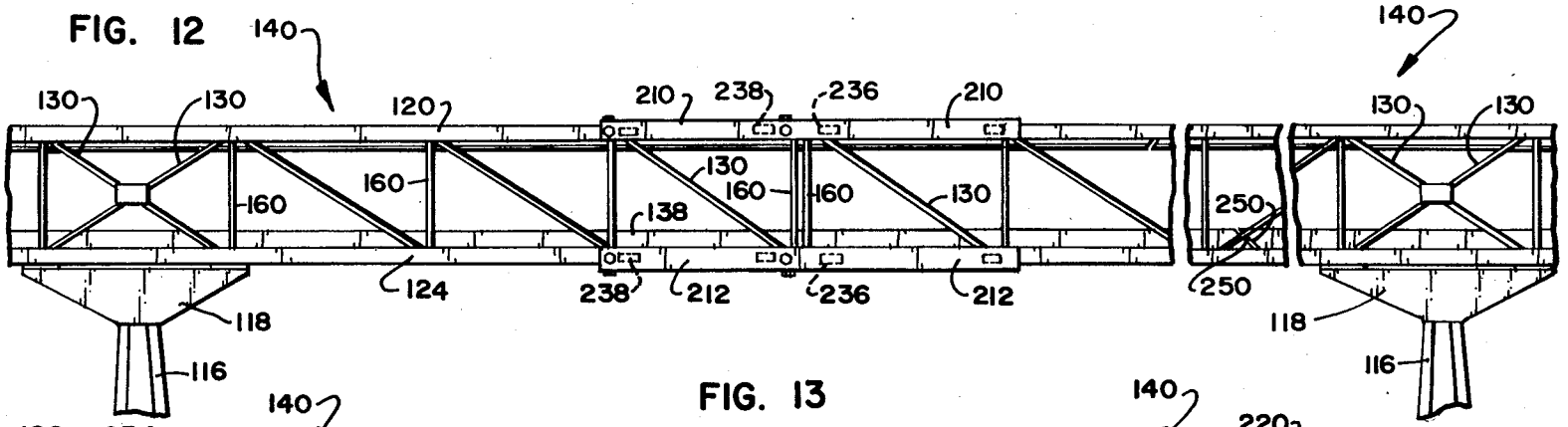
FIG. 12 is a partial elevational view of a preferred alternate guideway structure.
Figure 13:
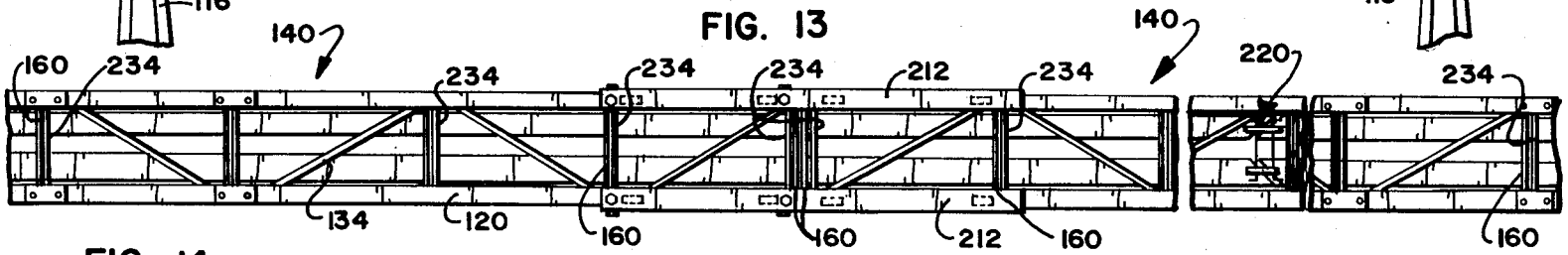
FIG. 13 is a partial diagrammatic bottom view of the guideway shown in FIG. 12.
Figure 14:
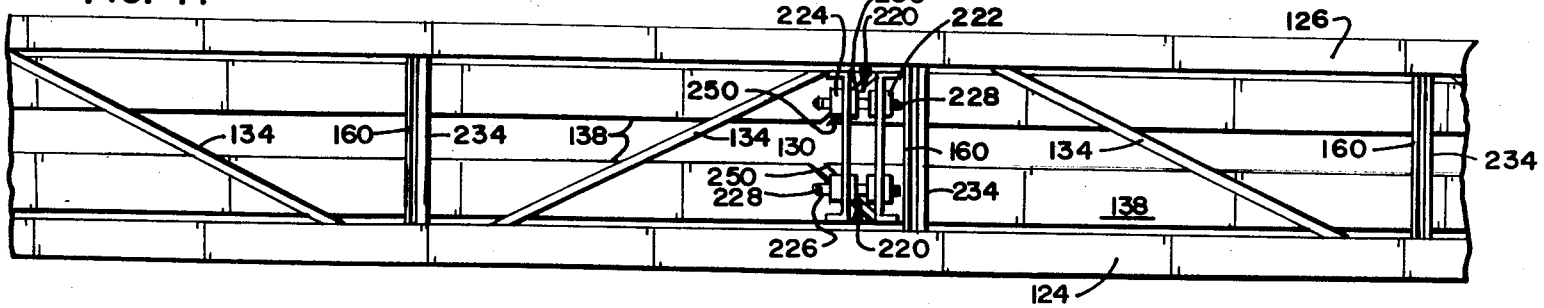
FIG. 14 is a partial diagrammatic bottom view, on an enlarged scale, of the guideway shown in FIG. 13.
Figure 15:
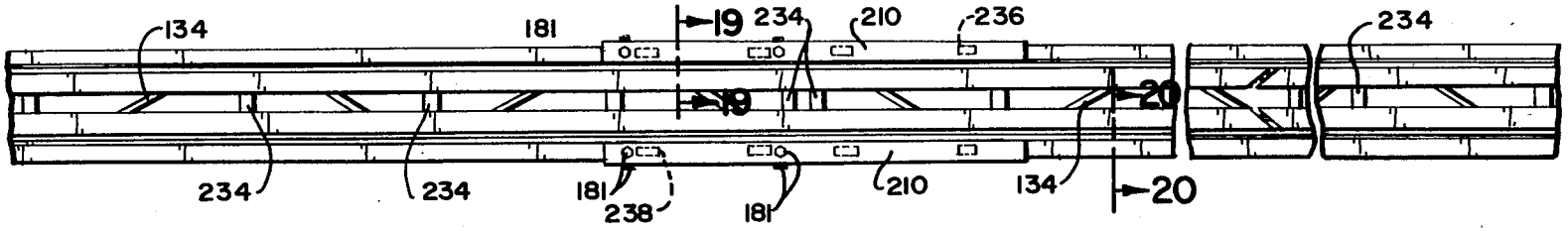
FIG. 15 is a partial diagrammatic top view of the guideway shown in FIG. 12.
Figure 17:
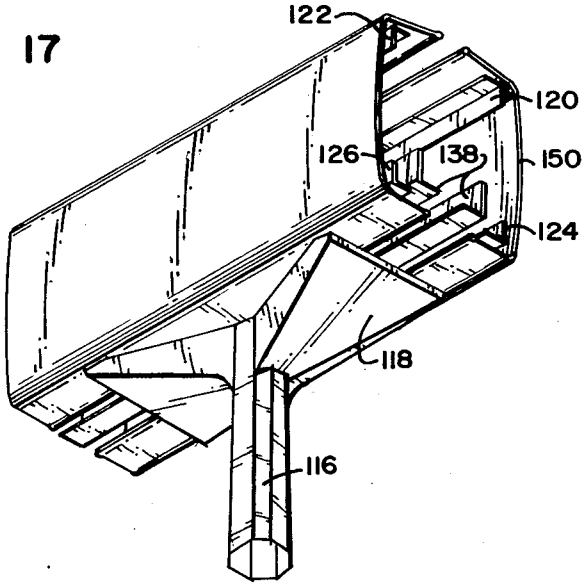
FIG. 17 is a partial diagrammatic perspective view of the alternate guideway.

Each guideway section 140 includes a pair of spaced apart parallel wheel support channels 138 each comprising a continuous section of material substantially the length of the guideway section. The support channel sections are affixed above the U-shaped ribs 160 so that the ends of the support channels are longitudinally spaced from the end of the guideway section 140. As can be seen in FIGS. 12 and 14, the support channel ends 250 are positioned neither above the support posts 116, nor at the joint between adjacent guideway sections 140. The ends 250 of the support channels 138 can be placed between 35 and 65% of the length of the guideway section from the end of the guideway section 140. This places the end 250 of the support channels 138 near the midpoint of the guideway section 140. In this way, rider comfort is increased as the joints of the actual support channel or roadway surface are longitudinally spaced from the support posts and guideway section joints. Thus, slope discontinuity of the support channel is minimized or eliminated.

The wheel support channel 138 may have an L-shaped cross-section with the base portion 143 lying in a horizontal plane and an arm portion 145 lying in a vertical plane. (See FIG. 16). The ends 250 of the support channels 138 are cut on a bias with respect to the longitudinal axis of the support channel 138. This bias angle should be between 30 and 60°. It is expected that an angle of approximately 45° will prove satisfactory. This angle allows the support channels 138, and corresponding roadway surface to be slightly spaced apart to allow for expansion during daily and seasonal heating of the guideway sections 140. The angle, however, accommodates transition of the vehicle wheels from one support channel 138 to the adjacent channel 138 without a noticeable bump and the resulting discomfort to riders.

The support channels 138 also include coupling means for affixing the ends of the support channel together to form a continuous vehicle support channel. The coupling means align the channels and allow shear forces to be transmitted from one support channel to the adjacent support channel while longitudinal forces are not transmitted but are absorbed by motion of one support channel with respect to its adjacent support channel. The coupling means 220 includes a pair of coaxial coupling collars 222 and 224, one of which is affixed to each adjacent end of the support channels 138. (See FIG. 14, and FIG. 16). A slidable coupling pin 226 is coaxially received within each pair of coupling collars 222 and 224, retained therein by a pair of keeper pins. It should be noted that the slidable coupling pin 226 is long enough to accommodate expansion and contraction of the guideway sections while limiting the maximum contraction with the keeper pins 228 (See FIG. 25).

The coupling collars 222 and 224 may be affixed directly to the base 143 or arm 145 of the wheel support channel 138. They may also be affixed to cross arms 230 which are themselves affixed to the support channels 138. (See FIGS. 16 and 25).

The support channels 138 are provided with a structure for maintaining the relative spacing therebetween. The support channel spacing means 232 may comprise a cross beam 234. The cross beam 234 may be directly welded to the support channel 138 and may rest between the support channel and the U-shaped ribs 160. (See FIGS. 19 and 20).

The support channels 138, which are affixed to and spaced from each other by the cross beam 234 can be adjusted within the guideway 140 with shims 244 and adjustable spacing bolts 246. The spacing bolt 246 allows the pair of support channels to be moved laterally within the guideway 140. The shims 244 allow precise vertical adjustment of the support channels 138 within the guideway 140. The spacer bolts 246 and shims 244 may prove totally unnecessary as proper installation of the guideway should be possible without the need for these adjustments.

The guideway can be enclosed within a cover 150 which substantially encloses the guideway but for an upper vehicle passage slit 158 located generally between the upper horizontal stringers 120 and 122, and a lower drainage slit 159 located generally between the lower horizontal stringers 124 and 126. The cover includes a means for hingedly affixing the cover to the lower horizontal stringers 124 and 126. A means for removably attaching the cover to the upper horizontal stringers 120 and 122 is also included. These hinge means and removable attachment means can include hinges 170 and pin fixtures 172.

Cover spacers 254 are positioned between the cover 150 and the horizontal stringers 120–126. Adjacent the joints between guideway sections, smaller cover spacers 256 rest between the overlapping members 210 and 212 and the cover 150.

Figure 23:
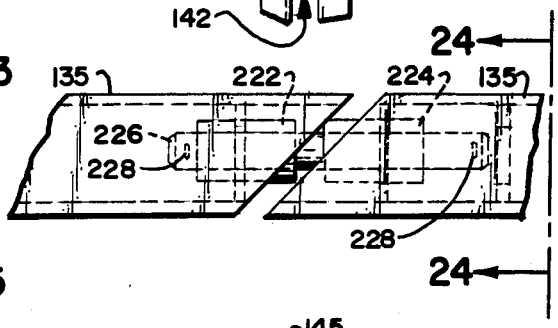
FIG. 23 is a partial elevational view of another portion of the guideway shown in FIG. 12 showing certain constructional details on an enlarged scale.
Figure 24:
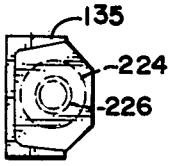
FIG. 24 is a cross-sectional view taken generally along line 24—24 in FIG. 23.

In reference now specifically to FIGS. 23 and 24, the expansion joints between adjacent sections of the vehicle stabilizing upper support channel 135 are shown. The support channel 135 is located parallel to the horizontal stringers 120–126 within the guideway 140 and generally above the wheel support channels 138. A pair of coupling collars 222 and 224 and a coupling pin 226 with keeper pins 228 is provided. The structure and function of these components is simpler than that described above with respect to the wheel support channels 138. The upper support channel sections 135 have ends which are cut on a bias of between 30° and 60° degrees with respect to the longitudinal axis of the upper support channel sections. As discussed above, this bias allows the wheeled vehicle to pass across the joint without a significant bump. An angle of approximately 45° is expected to function satisfactorily.

Figure 25:
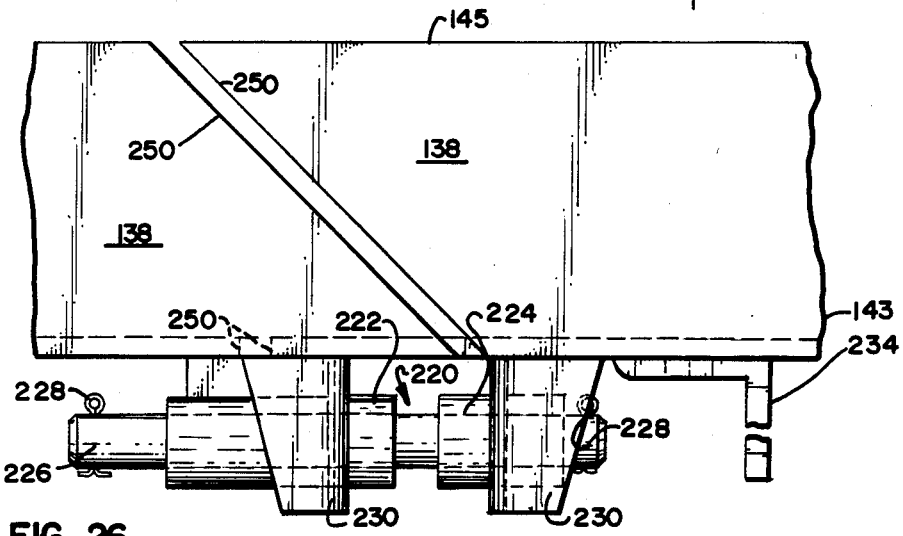
FIG. 25 is a partial elevational view of the guideway of FIG. 12 showing certain constructional details on an enlarged scale.
Figure 26:
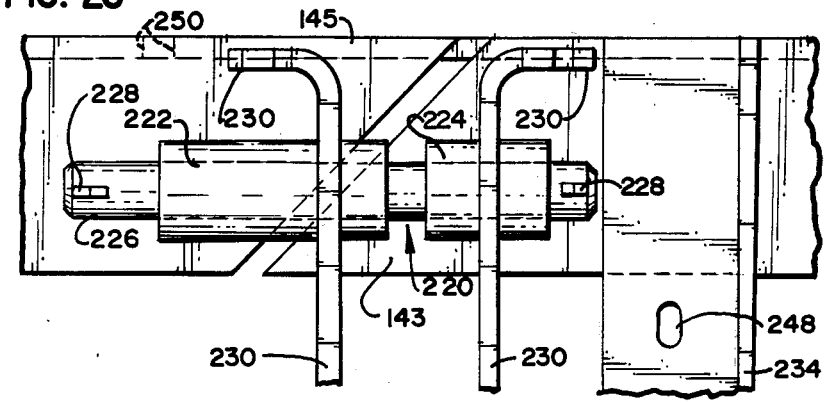
FIG. 26 is a bottom plan view of the guideway shown in FIG. 25.

In reference now specifically to FIGS. 25 and 26, further constructional details of the wheel support channel coupling means 220 are shown. The coupling collars 222 and 224 and the coupling pin 226 and the keeper pins 228 are shown on an enlarged scale. The cross arms 230 may comprise elongated members having the ends bent back to form a generally C-shaped member. The cross arms 230 may be affixed to the support channels 138 in any convenient fashion. The cross beams 234 may include slots 248 which accommodate lateral movement of the support channels 138 during alignment of the roadway surface within the guideway 140. The cross beam slots 248 receive bolts or the like as shown in FIGS. 19 and 20.

Thermal expansion of the guideway is accommodated by the slight, controlled longitudinal sliding of a portion of the support channels 138 over certain of the U-shaped ribs 160. In reference to FIG. 12, the portion of the support channels to the left of the joint between the guideway sections 140 and the ends 250 of the support channels 138 are rigidly affixed to the U-shaped ribs 160. (The left end of the support channel 138 which spans the joint between the guideway sections, is not shown in the drawings, but would lie roughly near the midpoint of the guideway section to the left of the guideway section joint in FIG. 12). The portion of the support channels to the right of the joint between the guideway sections 140 and the ends 250 of the support channel 138 can move longitudinally in a controlled fashion over the U-shaped ribs 160 to which it is attached as described below. This controlled motion allows the guideway sections 140 and the support channel sections 138 to expand and contract as necessary to accommodate daily and seasonal temperature variations.

Figure 27:
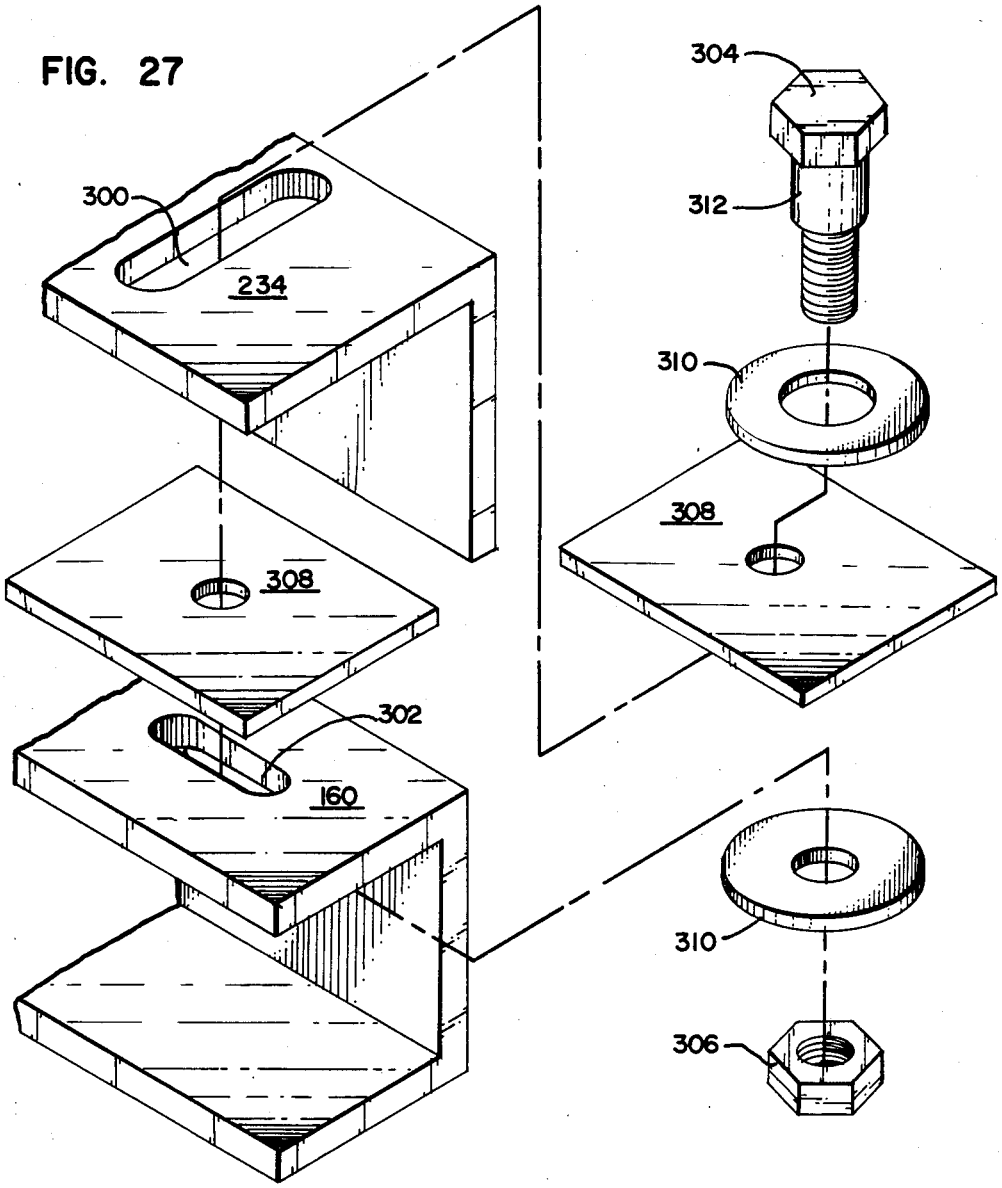
FIG. 27 is a partial perspective view of a portion of the invention on an enlarged scale.
Figure 28:
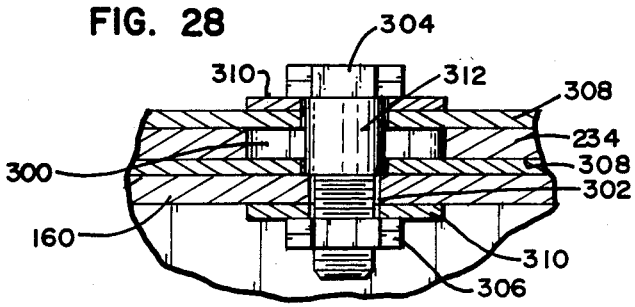
FIG. 28 is a longitudinal sectional view taken along and through the slot 300 shown in FIG. 27.

In reference now to FIGS. 27 and 28 the attachment of the sliding portion of the support channels 138 to the U-shaped ribs 160 is shown. On this portion of the track only, the cross beams 234 include a longitudinally extending slot 300 which lies above laterally extending slot 302 in the U-shaped rib 160. A shoulder bolt 304 passes through slots 300 and 302 and engages a nut 306. Antifriction or wear pads 308 lie between the cross beams 234 and the ribs 160, with washers 310 installed as necessary. The nut 306 rigidly affixes rib 160 against the shoulder 312 of shoulder bolt 304. As seen in FIG. 28 the cross beam can move in the longitudinal direction within the limits of slot 300 which receives the shoulder 312 of shoulder bolt 304. The shoulder 312 should generally be of the same dimension as the width of slot 300. Once installation of the support channel 138 has been accomplished, bolt 304 should not move within slot 302 except during periodic realignment of the support channel, if necessary. The wear pads 308 prevent noise and rubbing of the metal parts.

Figure 16:
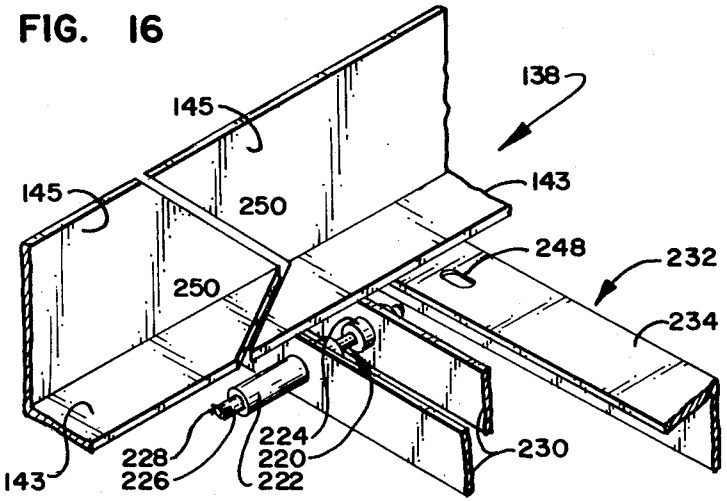
FIG. 16 is a partial perspective view, on an enlarged scale, of the support channel of the guideway shown in FIG. 12.
Figure 21:
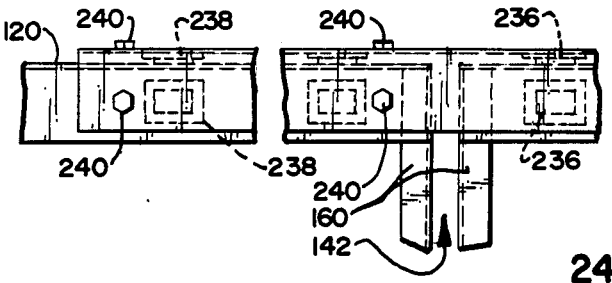
FIG. 21 is an elevational view of a portion of the guideway shown in FIG. 12, on an enlarged scale with portions broken away and showing certain construction details.
Figure 22:
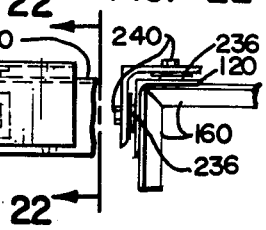
FIG. 22 is a cross-sectional view taken generally along line 22—22 in FIG. 21.

The non-sliding portion of the support channel, (the portion to the left of the guideway section joint in FIG. 12) is affixed to the U-shaped ribs 160 with a structure like that shown in FIG. 16. The slot 248 on cross beam 234 receives a bolt (not shown) and allows for lateral adjustment. The bolt would then pass through a hole in the U-shaped rib 160 to rigidly affix the cross beam 234 and the rib 160 together.

Certain materials are expected to function particularly well in construction of the guideway. Particularly, the U-shaped ribs 160 may be constructed of channel shaped material and the horizontal stringers and support channels may be constructed of angle or L-shaped material. It is important in construction of the guideway to be certain that rain water, is not retained within any structure. Therefore the channel shaped members are affixed so as to not present a trough or cup shaped region which might retain moisture.

METHOD OF INSTALLATION

The above-disclosed guideway can be installed in an easy and simplified process. The guideway is composed of a series of guideway sections each of substantially uniform length. Each section is elevated above the ground by a support post 116 with a support post cap 118. Each section includes a pair of upper horizontal stringers 120 and 122 and a pair of lower horizontal stringers 124 and 126. The stringers are affixed to and substantially enclose a plurality of upwardly opening U-shaped reinforcing ribs 160 spaced from each other along the length of the guideway sections 140. The method of installing the elevated guideway proceeds as follows:

A plurality of support posts 116 are installed at substantially uniform distances along the desired path of the guideway; and once of the guideway sections 140 is positioned over one of the support posts 116 so that the support post is positioned approximately 25% of the length of the guideway section from one end thereof. The support post and associated support post cap 118 are positioned vertically below two of the U-shaped ribs 160. The previously positioned guideway section is lowered onto the support post 116 and the associated support post cap 118 and rigidly affixed thereto; (see the discussion above with respect to "clamping" the post to the guideway section) a pair of lower extended overlapping members 212 are then affixed to the lower stringers 124 and 126 at one end of the guideway section 140. The overlapping members should extend beyond the end of the guideway section 140. The next adjacent guideway section 140 is positioned above the adjacent post as described above and lowered into position adjacent to the previously installed guideway section so that the end of the second guideway section away from the support post con tacts the overlapping members 212 and is itself positioned in end-to-end relationship with the previously installed guideway section. The second guideway section can be rested upon the overlapping members while a pair of upper overlapping members 210 are affixed to the first guideway section to embrance the second guideway section in bayonet or telescoping fashion. The guideway sections 140 are longitudinally slidable with respect to each other and form a continuous, smooth vehicle supporting elevated guideway.

By affixing the lower overlapping members first, and then lowering the adjacent guideway section into position, followed by affixing the upper overlapping members, rapid construction of the guideway can be accomplished with little difficulty.

The main wheel support channels can be affixed within the guideway sections after erection of the guideway. The vehicle stabilizing upper support channel 135 can be installed within the guideway substantially parallel to and above the wheel support channels 138. Both the support channels 138 and the upper support channel 135 may include ends cut on a bias between 30° and 60° with respect to the longitudinal axis to accommodate smooth passage of vehicle wheels over the joints. The coupling collars 222 and 224 and coupling pins 226 can be utilized.

Practicing this method, including the features set forth above should produce an inexpensive, functional, lightweight, oscillation resistant guideway capable of carrying a high volumn of traffic at reasonable speeds.

A number of characteristics and advantages of the invention have been set forth together with the structure and operation of the preferred embodiment of the guideway construction. The novel features thereof are pointed out in the following claims. The above disclosure is merely illustrative, and changes may be made in detail with respect to size, shape, choice of materials and structural arrangement within the principles of the invention to the full extend intended by the broad general meaning of the terms expressed in the claims.

We claim:

1. A continuous wheeled vehicle supporting guideway having:

a plurality of guideway sections, each section being of substantially uniform length and affixed in end-to-end relation, each of said sections comprising:

a pair of upper horizontal stringers located parallel to each other and a pair of lower horizontal stringers located parallel to each other and placed parallel to and below said upper horizontal stringers;

a plurality of upwardly opening U-shaped reinforcing ribs spaced from each other, said ribs affixed to and substantially enclosed within said stringers, said ribs in regular spaced relation to each other substantially along the entire length of each said guidewal section;

a plurality of diagonal members affixed in tension to said upper and lower horizontal stringers in vertical planes and generally spanning the diagonal distance between said spaced U-shaped ribs;

a plurality of horizontally oriented diagonal members affixed to and joining said lower horizontal stringers and generally spanning the diagonal distance between said spaced U-shaped ribs;

a pair of parallel main wheel support channels affixed to said U-shaped ribs, each said main wheel support channel comprises a continuous section of material substantially the said length of said guideway section, said support channel section affixed to said U-shaped ribs so that the ends of said support channels are longitudinally spaced from the end of said guideway section a distance of between 35 and 65 percent of said length of said guideway section;

means for elevating said guideway sections a desired distance above the ground, said elevation means located beneath said guideway sections and including a plurality of support posts, one of said posts being clamped at four points, each of said clamping points spaced from each adjacent clamping point at least a distance equal to a distance between said mean wheel support channels beneath each of said guideway sections approximately 25% of the length of said guideway section from one end of said section; and, a plurality of extended upper and lower overlapping members, each of said members being respectively affixed at one end thereof to one end of one of said upper or said lower horizontal stringers of a first guideway section, said overlapping members extending beyond the ends of the horizontal stringers to slidably receive the adjacent end of a second guideway section.

2. The guideway of claim 1 wherein said overlapping members are rigidly affixed to said first guideway section outside of said upper and lower horizontal stringers, said overlapping members receiving said second guideway section in telescoping fashion.

3. The guideway of claim 1 further comprising a coupling means for affixing said ends of said support channels in end-to-end relation forming a continuous vehicle support channel so that shear forces are transmitted from one support channel section to the adjacent support channel section while longitudinal forces are not transmitted from one support channel section to the adjacent support channel section.

4. The guideway of claim 3 wherein said coupling means includes a pair of coaxial coupling collars, one of said collars affixed adjacent each end of said support channel, and a slidable coupling pin coaxially received within each said pair of coupling collars.

5. The guideway of claim 1 wherein each said support channel comprises a member having an L-shaped cross section with a base portion and an arm portion, said base portion and said arm portion being cut on a bias at the said ends of said support channel sections.

6. The guideway of claim 5 wherein said bias angle is between 30 and 60 degrees with respect to the longitudinal axis of said support channel section.

7. The guideway of claim 1, further comprising:

means for substantially enclosing said guideway but for an upper vehicle passage slit located between said upper horizontal stringers and a lower drainage slit located between said lower horizontal stringers, said enclosing means including a cover and means for hingedly affixing said cover to said lower horizontal stringers and means for removably attaching said cover to said upper horizontal stringers, said cover further including a plurality of individual panel members hingedly affixed in end-to-end relationship to substantially enclose said guideway, yet individually movable to uncover said guideway, and said panel members further including hinges and pin fixtures which comprise said hinge means and removable attachment means respectively.

8. The guideway of claim 1 further comprising means for maintaining the relative spacing between said main wheel support channels, said space maintaining means including an elongated member affixed to said support channels and resting between said support channels and said U-shaped ribs.

9. The guideway of claim 1 further comprising wear pads positioned between said overlapping members. and said second guideway section, and spacer pads positioned between said overlapping members and said first guideway section.

10. The guideway of claim 9 wherein said overlapping members are affixed to said upper and said lower horizontal stringers of said first guideway section with bolts.

11. The guideway of claim 1 further comprising a pair of vehicle stabilizing upper support channel sections substantially the said length of said guideway located parallel to said horizontal stringers within said guideway generally above said wheel support channels.

12. The guideway of claim 1 wherein said U-shaped ribs are constructed of channel shaped material and said horizontal stringers are constructed of material having an L-shaped cross-section.

13. The guideway of claim 11 wherein said upper support channel sections have ends cut on a bias of between 30 and 60 degrees with respect to the longitudinal axis of said upper support channel section.

14. The guideway of claim 1 further comprising a means for adjusting the relative spacing of said vehicle support channel within said guideway, said adjusting means including shims and adjustable spacers between said U-shaped ribs and said vehicle support channel.

15. A method of installing a prefabricated vehicle supporting guideway, said guideway having a plurality of individual guideway sections of substantially uniform length, each said section elevated above the ground by a support post, each said section including a pair of upper stringers parallel to each other and spaced in parallel fashion above a pair of lower stringers, said upper and lower stringers affixed to and substantially enclosing a plurality of upwardly opening U-shaped reinforcing ribs, said ribs spaced from each other along the length of said section and supporting a pair of main wheel support channels, the ends of which are longitudinally spaced from an end of the guideway section a distance of between 35 and 65 percent of said length of the guideway section said method comprising the steps of:

(1) installing a plurality of said support posts at substantially uniform distances along the desired path of said guideway;

(2) positioning one of said guideway sections over one of said posts so that said post is positioned approximately 25% of the length of said guideway section from one end and said post is positioned vertically below two of said U-shaped ribs;

(3) lowering said previously positioned guideway section onto said support post and clamping said guideway section to said support post at at least four points to said lower stringers;

(4) affixing a pair of lower extended overlapping members to said lower stringers at the one end of said guideway section, said overlapping members extending beyond the end of said section;

(5) repeating steps 2–4 for an adjacent post along said desired path with a subsequent section so that said subsequent section contacts the portion of said overlapping members beyond the end of said guideway section and said guideway section and said subsequent guideway section are in end-to-end relationship;

(6) resting said subsequent section on said lower overlapping members in longitudinally slidable fashion; and (7) affixing a pair of upper extended overlapping members to said upper stringers of said guideway section and resting said upper overlapping members on said upper stringers of said subsequent section, said guideway sections respectively longitudinally slidable and forming a continuous, smooth vehicle supporting elevated guideway.

16. The method of claim 15 wherein said lower and said upper overlapping members comprise means for transmitting shear forces of said guideway section to said subsequent section, while allowing limited longitudinal forces to be absorbed by relative motion between said guideway sections, said means including elongated members having an L-shaped cross-section mounted to said stringers of said guideway section.

17. The method of claim 15 further comprising the step of affixing a main wheel support channel section to said U-shaped members within each section of said guideway and affixing a coupling means to the ends of said support channel sections, said coupling means transmitting shear forces from one support channel section to the adjacent support channel section while allowing limited longitudinal motion of one support channel section with respect to said adjacent support channel section.

18. The method of claim 17 wherein said coupling means includes a pair of coaxial coupling collars, one of said collars affixed adjacent each end of said support channel, and a slidable coupling pin coaxially received within each said pair of coupling collars.

19. The method of claim 17 wherein said support channel includes a member having an L-shaped cross section with a base portion and an arm portion, said base portion and said arm portion being cut on a bias at the said ends of said support channel sections.

20. The method of claim 19 wherein said bias angle is between 30 and 60 degrees with respect to the longitudinal axis of said support channel section.

21. The method of claim 17 further comprising the step of affixing a vehicle stabilizing upper support channel within said guideway section substantially parallel to and above said wheel support channel.

* * * * *